US009887504B1

(12) United States Patent
Luo

(10) Patent No.: US 9,887,504 B1
(45) Date of Patent: Feb. 6, 2018

(54) FOUR-PIN AC PARALLEL CONNECTOR AND MALE AND FEMALE THEREOF

(71) Applicant: TI-LANE PRECISION ELECTRONIC CO .,LTD., Shenzhen (CN)

(72) Inventor: Baojun Luo, ShenZhen (CN)

(73) Assignee: TI-Lane Precision Electronic Co., Shenzhen (CN)

( * ) Notice: Subject to any disclaimer, the term of this patent is extended or adjusted under 35 U.S.C. 154(b) by 0 days.

(21) Appl. No.: 15/327,980

(22) PCT Filed: Feb. 3, 2016

(86) PCT No.: PCT/CN2016/073245
§ 371 (c)(1),
(2) Date: Jan. 20, 2017

(87) PCT Pub. No.: WO2017/124587
PCT Pub. Date: Jul. 27, 2017

(30) Foreign Application Priority Data

Jan. 22, 2016 (CN) ..... 2016 1 0046685

(51) Int. Cl.
*H01R 25/00* (2006.01)
*H01R 31/02* (2006.01)
(Continued)

(52) U.S. Cl.
CPC ..... *H01R 31/02* (2013.01); *H01R 13/4367* (2013.01); *H01R 13/506* (2013.01);
(Continued)

(58) Field of Classification Search
CPC .... H01R 31/02; H01R 13/506; H01R 13/193; H01R 13/432; H01R 13/622;
(Continued)

(56) References Cited

U.S. PATENT DOCUMENTS 4,990,104 A * 2/1991 Schieferly ..... H01R 13/432 439/578
5,514,001 A * 5/1996 Szegda ..... H01R 13/193 439/259

(Continued)

FOREIGN PATENT DOCUMENTS

| | | | |
|---|---|---|---|
| CN | 264528 | Y | 9/2004 |
| CN | 101145661 | A | 3/2008 |
| CN | 20288424 | U | 4/2013 |
| JP | H04160780 | A | 6/1992 |
| JP | 2009193839 | A | 8/2009 |

OTHER PUBLICATIONS

ISR for PCT/CN2016/073245 completed Dec. 10, 2016.

*Primary Examiner* — Jean F Duverne
(74) *Attorney, Agent, or Firm* — Schmeiser, Olsen & Watts LLP

(57) ABSTRACT

Disclosed is a four-pin AC parallel connector and a male and a female thereof. The male is composed of a male body, a four-pin male conductor, a retainer, an inner housing, a sleeve, an outer housing and an AC four-pin lead; and the female is composed of a female body, an inner housing, a sleeve, an outer housing, an AC four-pin lead and a four-pin female conductor. The four-pin AC parallel connector and the male and the female thereof of the invention is simple in mounting and dismounting operations, small in volumes and good in sealing property, the working stability is improved, and the service lives are prolonged.

10 Claims, 2 Drawing Sheets

(51) Int. Cl.

| | |
|---|---|
| ***H01R 24/28*** | (2011.01) |
| ***H01R 24/20*** | (2011.01) |
| ***H01R 13/436*** | (2006.01) |
| ***H01R 13/514*** | (2006.01) |
| ***H01R 13/506*** | (2006.01) |
| *H01R 107/00* | (2006.01) |

(52) U.S. Cl.
CPC ..... *H01R 13/514* (2013.01); *H01R 24/20* (2013.01); *H01R 24/28* (2013.01); *H01R 2107/00* (2013.01)

(58) Field of Classification Search
CPC .. H01R 13/514; H01R 13/4367; H01R 24/20; H01R 24/28; H01R 4/2433
See application file for complete search history.

(56) References Cited

U.S. PATENT DOCUMENTS

| | | | | |
|---|---|---|---|---|
| 6,280,229 | B1 * | 8/2001 | Harting ..... | H01R 4/2433 439/320 |
| 7,364,450 | B2 * | 4/2008 | Hafner ..... | H01R 13/622 439/253 |
| 7,850,472 | B2 * | 12/2010 | Friedrich ..... | H01R 13/506 439/256 |
| 9,142,914 | B2 * | 9/2015 | Jozwik ..... | H01R 13/622 |
| 9,559,459 | B2 * | 1/2017 | Jozwik ..... | H01R 13/622 |
| 9,768,529 | B2 * | 9/2017 | Starke ..... | H01R 4/2433 |

* cited by examiner

FOUR-PIN AC PARALLEL CONNECTOR AND MALE AND FEMALE THEREOF

FIELD OF THE INVENTION

The present invention relates to a four-pin AC parallel connector whose connection carrier interface requires opposite plug and a male and a female thereof.

BACKGROUND OF THE INVENTION

Existing connectors generally refer to connection units between various electronic components, and are mainly used for connecting and transmitting electronic signals between a single-chip circuit board and a circuit board and between a circuit board and a case. Currently, there are more than ten thousand types of connectors, which can be used in many aspects, such as computers, communication devices, televisions, aviation and other industrial products. Moreover, the connectors can be divided into circular connectors, angular connectors and connectors for printed wiring according to shapes, and can be divided into those for military use, communication, information, people's livelihood and aviation according to applications.

At present, these connectors whose connection carrier interfaces require opposite plug are often exposed in harsh environments for outdoor use, the common connectors whose connection carrier interfaces require opposite plug are just connected by chips, the structures thereof cannot be completely clamped, so that they will drop during use, resulting in poor connection, instability and short service lives; another type of connectors whose connection carrier interfaces require opposite plug need to be covered in a third party container after being connected to ensure the long-term service life of 25 years, the third party container is not conducive to the operation of random plug disconnection after being covered, and the volume is relatively huge, thereby indirectly increasing the cost of the product itself.

SUMMARY OF THE INVENTION

The objective of the present invention is to design a four-pin AC parallel connector which is simple in structure, decreased in volume, simple in dismounting operation, good in sealing property, stable to plug and high in working stability, and a male and a female thereof, to overcome the shortcomings of the aforementioned technology.

The male of the four-pin AC parallel connector designed in the present invention includes a male body, a four-pin male conductor, a retainer, an inner housing, a sleeve, an outer housing and an AC four-pin lead, wherein a clamping recess is formed in an end face of the male body; a connecting end of the four-pin male conductor is plugged into the retainer; a through hole matched with a plug end of the four-pin male conductor is formed in the male body, and the plug end of the four-pin male conductor is plugged into the through hole in the male body; the inner housing and the sleeve are both placed in a through cavity of the outer housing, and the inner housing is placed between the retainer and the sleeve; the AC four-pin lead is connected to the connecting end of the four-pin male conductor after passing through the sleeve and the inner housing successively and being inserted into the retainer; the retainer is embedded on the male body; and the outer housing and the male body are fit and fixed to each other.

Further, both of the male body and the four-pin male conductor can be cross-shaped or T-shaped.

Further, a positioning groove is formed at the location of the through hole in an end face of the male body.

Further, a stopper groove is formed in the through hole.

Further, one side face of the retainer is bumpy.

The present invention further designs a female of the four-pin AC parallel connector, including a female body, an inner housing, a sleeve, an outer housing, an AC four-pin lead and a tubular four-pin female conductor, wherein a buckle is further arranged on the female body; the inner housing and the sleeve are both placed in a through cavity of the outer housing; the sleeve is arranged at the top of the inner housing; the AC four-pin lead passes through the sleeve and the inner housing successively and is connected to one end of the four-pin female conductor, and the other end of the four-pin female conductor is plugged into the female body; a connecting end of the female body is tubular, and pins at the other end of the four-pin female conductor are arranged in a tube hole in the connecting end of the female body; and the inner housing and the outer housing are both fit and fixed to the female body.

Further, a plug structure between the other end of the four-pin female conductor and the female body is as follows: a through groove is formed in a connecting block at the top of the female body, and a fixing groove is formed at a position corresponding to the through groove on the tubular four-pin female conductor, and the tubular four-pin female conductor is fixed by clamping a bumpy fixture block into both the through groove and the fixing groove.

Further, the top of the connecting end of the tubular female body is arranged on a stop block.

Further, a sealing ring is sleeved on an outer side of an annular ellipse at the bottom of the tubular connecting end of the female body.

The present invention further designs a four-pin AC parallel connector, including the male of any one of claims 1-5 and the female of any one of claims 6-8, wherein the tubular connecting end on the female is matched with and plugged into the through hole in the male, and the annular ellipse at the bottom of the tubular connecting end on the female is plugged into the positioning groove of the male; the sealing ring is located between the outer side of the annular ellipse at the bottom of the tubular connecting end on the female and an inner wall of the positioning groove of the male; the pins of the female are plugged into and in contact with the plug end of the four-pin male conductor of the male; and the buckle is plugged and fixed into the clamping recess.

In an electronic connector interface of the four-pin AC parallel connector and the male and the female thereof designed by the present invention, the four-pin conductors are buried in the bodies in fourth paths and are arranged together with intermediate fences of the bodies to form a rectangle so as to achieve stable plug, the clamping recess in the end face of the male body and the clamping recess of the female body are convenient to dismount by a tool, reducing the structural components, thus reducing the volume, the annular ellipse at the middle is sealed and fixed in a shrinkage and attachment manner after being plugged with soft silica gel to ensure tight seal of the electronic connector interface, therefore the working stability is improved and the service life is prolonged.

Figure 1:
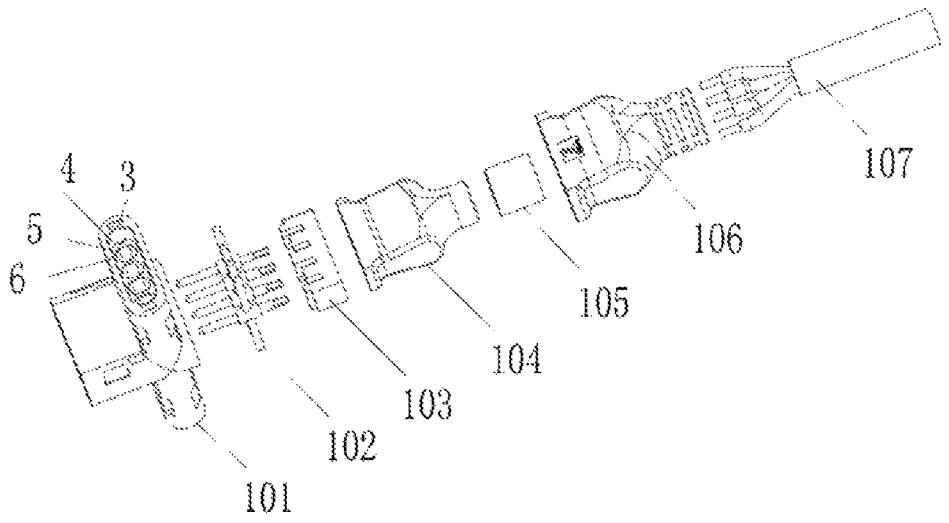
FIG. 1 is a structural schematic diagram of a four-way male in a first embodiment.

Reference signs in the figures: male body 101, four-pin male conductor 102, retainer 103, inner housing 104, sleeve 105, outer housing 106, AC four-pin lead 107, female body 201, four-pin female conductor 202, fixture block 203, clamping recess 3, positioning groove 4, through hole 5, stopper groove 6, sealing ring 7, fixing groove 8, through groove 9, buckle 10, and stop block 11.

DETAILED DESCRIPTION OF THE EMBODIMENTS

In combination with the accompanying drawings in the embodiments of the present invention, a clear and complete description of technical solutions in the embodiments of the present invention will be given below. The embodiment described below is one of the embodiments of the present invention, all of other embodiments obtained by those who have ordinary skill in the art without any creative effort, are falling into the protection scope of the present invention.

Embodiment 1

Figure 2:
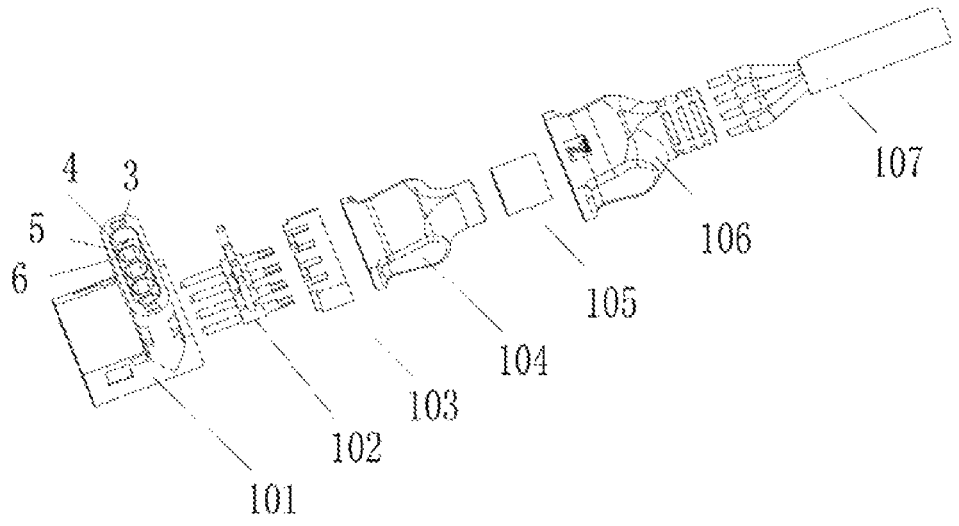
FIG. 2 is a structural schematic diagram of a three-way male in the first embodiment.

As shown in FIG. 1 and FIG. 2, a male of a four-pin AC parallel connector described in the present invention includes a male body 101, a four-pin male conductor 102, a retainer 103, an inner housing 104, a sleeve 105, an outer housing 106 and an AC four-pin lead 107, wherein a clamping recess 3 is formed in an end face of the male body 101; a connecting end of the four-pin male conductor 102 is plugged into the retainer 103; a through hole 5 matched with a plug end of the four-pin male conductor 102 is formed in the male body 101, and the plug end of the four-pin male conductor 102 is plugged into the through hole 5 in the male body 101; the inner housing 104 and the sleeve 105 are both placed in a through cavity of the outer housing 106; the inner housing 104 is placed between the retainer 103 and the sleeve 105; the AC four-pin lead 107 is connected to the connecting end of the four-pin male conductor 102 after passing through the sleeve 105 and the inner housing 104 successively and being inserted into the retainer 103; the retainer 103 is embedded on the male body 101; the outer housing 106 and the male body 101 are fit and fixed to each other; further, the sleeve 105 is fixed between the opening of the top of the outer housing 106 and an outer wall of the AC four-pin lead 107.

In the embodiment, both of the male body 101 and the four-pin male conductor 102 can be cross-shaped or T-shaped. Therefore, the cross-shaped male body and the cross-shaped four-pin male conductor are combined to form the male of a four-way four-pin AC parallel connector, and the T-shaped male body and the T-shaped four-pin male conductor are combined to form the male of a three-way four-pin AC parallel connector, and thus the multi-way purpose of the connector whose connection carrier interface requires opposite plug is achieved.

In the embodiment, a positioning groove 4 is formed at the location of the through hole 5 in an end face of the male body 101, in order to fulfill a shielding purpose during outdoor exposure after the opposite plug.

In the embodiment, a stopper groove 6 is formed in the through hole 5 to play positioning and stopping roles.

In the embodiment, one side face of the retainer 103 is bumpy, so that the retainer 103 can be fixed on the male body 101 and is more convenient to plug.

Figure 3:
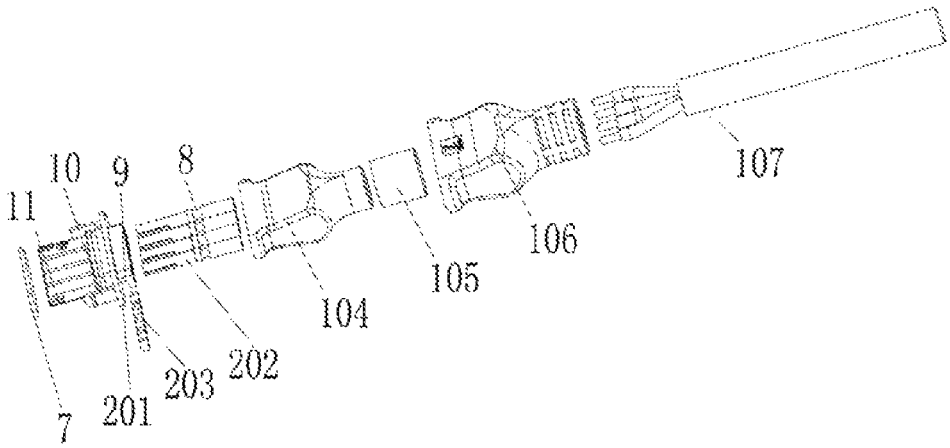
FIG. 3 is a structural schematic diagram of a female in the first embodiment.

As shown in FIG. 3, a female of the four-pin AC parallel connector described in the embodiment includes a female body 201, an inner housing 104, a sleeve 105, an outer housing 106, an AC four-pin lead 107 and a tubular four-pin female conductor 202, wherein a buckle 10 is further arranged on the female body 201; the inner housing 104 and the sleeve 105 are both placed in a through cavity of the outer housing 106; the sleeve 105 is arranged at the top of the inner housing 104; the AC four-pin lead 107 passes through the sleeve 105 and the inner housing 104 successively and is connected to one end of the four-pin female conductor 202, and the other end of the four-pin female conductor 202 is plugged into the female body 201; a connecting end of the female body 201 is tubular; pins at the other end of the four-pin female conductor 202 are arranged in a tube hole in the connecting end of the female body 201; the inner housing 104 and the outer housing 106 are both fit and fixed to the female body 201; further, the sleeve 105 is fixed between the opening of the top of the outer housing 106 and an outer wall of the AC four-pin lead 107.

In the embodiment, a plug structure between the other end of the four-pin female conductor 202 and the female body 201 is as follows: a through groove 9 is formed in a connecting block at the top of the female body 201, a fixing groove 8 is formed at a position corresponding to the through groove 9 on the tubular four-pin female conductor 202, and the tubular four-pin female conductor 202 is fixed by clamping a bumpy fixture block 203 into both the through groove 9 and the fixing groove 8, so that the four-pin female conductor can be fixed on the female body more firmly, the compactness of the structure is improved, and the assembly is more convenient.

In the embodiment, the top of the connecting end of the tubular female body 201 is arranged on a stop block 11 for stopping the female.

In the embodiment, a sealing ring 7 is sleeved on an outer side of an annular ellipse at the bottom of the tubular connecting end of the female body 201, so as to avoid disconnection in an outdoor exposure process after being plugged and fixed in to the male, and the sealing ring is convenient to dismount and mount and has a tight sealing function.

Figure 4:
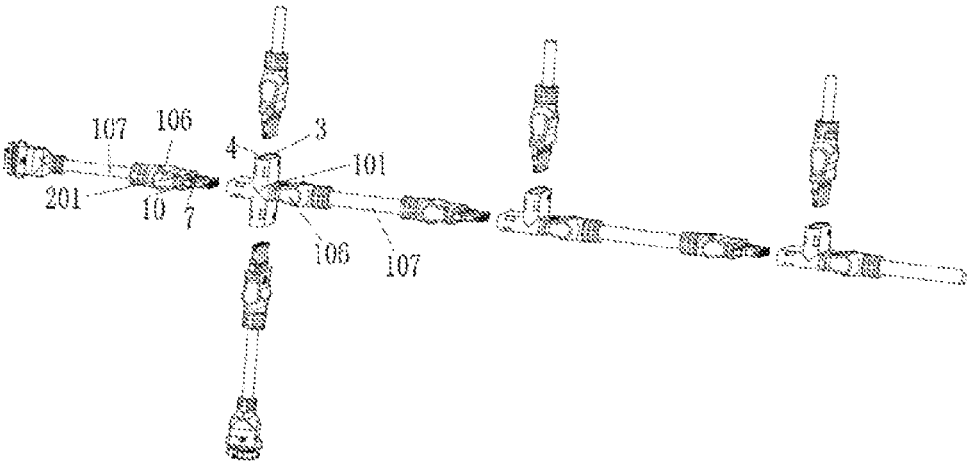
FIG. 4 is a schematic diagram of an overall connecting structure of the three-way male and the four-way male with the female.

As shown in FIG. 4, the four-pin AC parallel connector in the embodiment includes the male of any one of claims 1-5 and the female of any one of claims 6-8, wherein the tubular connecting end on the female is matched with and plugged into the through hole in the male, and the annular ellipse at the bottom of the tubular connecting end on the female is plugged into the positioning groove 6 of the male; the sealing ring 7 is located between the outer side of the annular ellipse at the bottom of the tubular connecting end on the female and an inner wall of the positioning groove 6 of the male; the pins of the female are plugged into and in contact with the plug end of the four-pin male conductor 102 of the male, and the buckle 11 is plugged and fixed into the clamping recess 3; and the sealing ring has elasticity and is fit between the outer side of the annular ellipse at the bottom of the tubular connecting end on the female and the inner wall of the positioning groove of the male in a shrinkage and attachment manner by means of its elasticity, and the pins of the female are enclosed into the four-pin male conductor of the male to achieve good mutual contact, which improves the connection performance.

The present invention is not limited to the aforementioned optimal embodiments, other various forms of products may be derived from the teachings of the present invention by anyone, but any change in the shape or structure, as long as having identical or similar technical solutions as those in the present applications, shall fall within the protection scope of the present invention.

The invention claimed is:

1. A male of a four-pin AC parallel connector, comprising a male body (101), a four-pin male conductor (102), a retainer (103), an inner housing (104), a sleeve (105), an outer housing (106) and an AC four-pin lead (107), wherein a clamping recess (3) is formed in an end face of the male body (101); a connecting end of the four-pin male conductor (102) is plugged into the retainer (103); a through hole (5) matched with a plug end of the four-pin male conductor (102) is formed in the male body (101), and the plug end of the four-pin male conductor (102) is plugged into the through hole (5) in the male body (101); the inner housing (104) and the sleeve (105) are both placed in a through cavity of the outer housing (106), and the inner housing (104) is placed between the retainer (103) and the sleeve (105); the AC four-pin lead (107) is connected to the connecting end of the four-pin male conductor (102) after passing through the sleeve (105) and the inner housing (104) successively and being inserted into the retainer (103); the retainer (103) is embedded on the male body (101); and the outer housing (106) and the male body (101) are fit and fixed to each other.

2. The male of the four-pin AC parallel connector of claim 1, wherein both of the male body (101) and the four-pin male conductor (102) can be cross-shaped or T-shaped.

3. The male of the four-pin AC parallel connector of claim 1, wherein a stopper groove (6) is formed in the through hole (5).

4. The male of the four-pin AC parallel connector of claim 1, wherein a positioning groove (4) is formed at the location of the through hole (5) in an end face of the male body (101).

5. The male of the four-pin AC parallel connector of claim 1, wherein one side face of the retainer (103) is bumpy.

6. A female of a four-pin AC parallel connector, comprising a female body (201), an inner housing (104), a sleeve (105), an outer housing (106), an AC four-pin lead (107) and a tubular four-pin female conductor (202), wherein a buckle (10) is further arranged on the female body (201); the inner housing (104) and the sleeve (105) are both placed in a through cavity of the outer housing (106); the sleeve (105) is arranged at the top of the inner housing (104); the AC four-pin lead (107) passes through the sleeve (105) and the inner housing (104) successively and is connected to one end of the four-pin female conductor (202), and the other end of the four-pin female conductor (202) is plugged into the female body (201); a connecting end of the female body (201) is tubular, and pins at the other end of the four-pin female conductor (202) are arranged in a tube hole in the connecting end of the female body (201); and the inner housing (104) and the outer housing (106) are both fit and fixed to the female body (201).

7. The female of the four-pin AC parallel connector of claim 6, wherein a plug structure between the other end of the four-pin female conductor (202) and the female body (201) is as follows: a through groove (9) is formed in a connecting block at the top of the female body (201), and a fixing groove (8) is formed in the tubular four-pin female conductor (202), the position of the fixing groove corresponding to that of the through groove (9), and the tubular four-pin female conductor (202) is fixed by clamping a bumpy fixture block (203) into both the through groove (9) and the fixing groove (8).

8. The female of the four-pin AC parallel connector of claim 6, wherein the top of the connecting end of the tubular female body (201) is arranged on a stop block (11).

9. The female of the four-pin AC parallel connector of claim 6, wherein a sealing ring (7) is sleeved on an outer side of an annular ellipse at the bottom of the tubular connecting end of the female body (201).

10. A four-pin AC parallel connector, comprising the male of any one of claims 1-5 and the female of any one of claims 6-9, wherein the tubular connecting end on the female is matched with and plugged into the through hole in the male, and the annular ellipse at the bottom of the tubular connecting end on the female is plugged into the positioning groove (6) of the male; the sealing ring (7) is located between the outer side of the annular ellipse at the bottom of the tubular connecting end on the female and an inner wall of the positioning groove (6) of the male; the pins of the female are plugged into and in contact with the plug end of the four-pin male conductor (102) of the male; and the buckle (11) is plugged and fixed into the clamping recess (3).

* * * * *